US006817622B2

(12) United States Patent
Dodge

(10) Patent No.: US 6,817,622 B2
(45) Date of Patent: Nov. 16, 2004

(54) MOUNTING DISK FOR A SNOWBOARD BINDING

(76) Inventor: David J. Dodge, 44 Goldenrod La., Williston, VT (US) 05495

( * ) Notice: Subject to any disclaimer, the term of this patent is extended or adjusted under 35 U.S.C. 154(b) by 0 days.

(21) Appl. No.: 09/942,113

(22) Filed: Aug. 29, 2001

(65) Prior Publication Data

US 2003/0042709 A1 Mar. 6, 2003

(51) Int. Cl.[7] ..... A63C 9/081
(52) U.S. Cl. ..... 280/618; 280/14.22
(58) Field of Search ..... 280/617, 618, 280/607, 14.21, 14.22, 14.24

(56) References Cited

U.S. PATENT DOCUMENTS

| | | | | | |
|---|---|---|---|---|---|
| 5,236,216 | A | | 8/1993 | Ratzek | 280/607 |
| 5,261,689 | A | | 11/1993 | Carpenter et al. | 280/618 |
| 5,277,635 | A | | 1/1994 | Gillis | 441/74 |
| 5,354,088 | A | | 10/1994 | Vetter et al. | 280/618 |
| 5,356,170 | A | | 10/1994 | Carpenter et al. | 280/618 |
| 5,480,176 | A | | 1/1996 | Sims | 280/618 |
| 5,499,837 | A | | 3/1996 | Hale et al. | 280/607 |
| 5,553,883 | A | | 9/1996 | Erb | 280/607 |
| 5,577,755 | A | | 11/1996 | Metzger et al. | 280/607 |
| 5,586,779 | A | | 12/1996 | Dawes et al. | 280/14.2 |
| 5,667,237 | A | | 9/1997 | Lauer | 280/607 |
| 5,762,358 | A | | 6/1998 | Hale | 280/607 |
| 5,826,910 | A | | 10/1998 | Ricks et al. | 280/618 |
| 5,909,893 | A | * | 6/1999 | Keller et al. | 280/607 |
| 5,941,552 | A | | 8/1999 | Beran | 280/607 |
| 5,967,542 | A | | 10/1999 | Williams et al. | 280/618 |
| 5,975,557 | A | | 11/1999 | Snoke et al. | 280/624 |
| 6,015,161 | A | | 1/2000 | Carlson | 280/626 |
| 6,061,870 | A | * | 5/2000 | Dodge et al. | 280/618 X |
| 6,062,584 | A | | 5/2000 | Sabol | 280/607 |
| 6,155,578 | A | | 12/2000 | Patterson | 280/14.24 |
| 6,189,899 | B1 | | 2/2001 | Carlson | 280/14.22 |
| 6,203,051 | B1 | | 3/2001 | Sabol | 280/607 |
| 6,206,402 | B1 | * | 3/2001 | Tanaka | 280/618 X |
| 6,206,403 | B1 | * | 3/2001 | Black et al. | 280/618 |
| 6,234,494 | B1 | * | 5/2001 | Gien | 280/14.24 |
| 6,296,258 | B2 | * | 10/2001 | Higgins et al. | 280/14.22 |
| 6,467,795 | B1 | * | 10/2002 | Hirayama et al. | 280/618 X |
| 2003/0132610 | A1 | * | 7/2003 | Miotto et al. | 280/618 |

* cited by examiner

*Primary Examiner*—Bryan Fischmann
(74) *Attorney, Agent, or Firm*—Bourque & Associates, P.A.

(57) ABSTRACT

A mounting disk for holding a binding base plate through a central aperture in said base plate to the top surface of a snowboard. The binding plate may be secured in a plurality of rotational positions relative to the disk. The mounting disk may be secured in a plurality of linear positions along the width and/or length of the snowboard top surface.

14 Claims, 7 Drawing Sheets

MOUNTING DISK FOR A SNOWBOARD BINDING

BACKGROUND OF THE INVENTION

1. Field of the Invention

The present invention relates to bindings for snowboards and the like, and more particularly to such bindings that comprise a disk that allows the bindings to be adjusted with respect to their angular orientation to the longitudinal centerline of the snowboard.

2. Description of the Prior Art

Snowboarding is a sport wherein a person uses a snowboard for recreational travel down a snow-covered inclined surface. In recent years, there has been a tremendous growth of the sport of snowboarding, and concomitantly more attention has been given to some of the problems experienced by snowboarders.

A typical snowboard is essentially a single, wide ski that has fore and aft binding assemblies that are secured to the board in a manner to support both feet at a substantial angle with respect to the longitudinal centerline of the board. This cross orientation of the bindings allows the user to assume a side-forward position necessary for optimum control of the board during active snowboarding. It is also noted that snowboarders often desire to modify the angle of the feet relative to the centerline of the board to achieve better performance during their run. Such changes in the angle of the feet are made for personal preference and riding style. Fine tuning of the angle is critical to achieving optimum performance.

It has become evident that one way to address these problems would be in providing bindings that are adjustable with respect to their angular orientations to the board centerline. State of the art bindings are mounted to snowboards by a circular disk that is positioned in a circular opening in a binding base plate designed to receive a person's foot and secured with screws to mating elements in the snowboard. There are currently two standard systems in common use in the snowboard industry. Many other systems have been envisioned but the industry has settled on the following two systems: the non-proprietary four-hole system and a proprietary three-hole system. Therefore, it is necessary to provide two separate disks with every binding in order to insure that the binding may be fitted on most snowboards.

Snowboard bindings are also preferably provided with means to allow adjustment in a direction that is generally perpendicular to the longitudinal centerline of the snowboard (i.e., from side to side). Such an adjustment allows the rider's boot to be centered laterally on the snowboard and thereby eliminates toe and heel drag: conditions that occur when either the toe of the boot or the heel of the boot extends beyond the turning edge of the snowboard. When several different boot sizes are to be accommodated by a single binding, the lateral adjustment of the binding is critical. This is done by providing elongated holes in the disk so that it may be adjusted relative to the longitudinal axis of the snowboard.

The 3-hole system is described in U.S. Pat. Nos. 5,261,689, 5,354,088 and 5,356,170.

U.S. Pat. No. 5,261,689 (Carpenter & al.) teaches a hold down plate with at least three holes extending in a common direction, a base plate forming a part of a binding for receiving the boot of a user and having an aperture for receiving the hold down plate in at least two rotational orientations, and a means defining a pattern of second holes in a snowboard formed such that first holes are aligned with a like number of second holes when the hold-down plate is placed over the snowboard for permitting the hold down plate to assume at least two spaced apart positions along the snowboard, each corresponding to a different rotational orientation of the hold down plate. This patent teaches the means to orient the hold down plate in at least two different orientations with respect to the snowboard central axis. This capability is afforded by the unique pattern of holes in the snowboard and in the hold down plate.

U.S. Pat. No. 5,354,088 (Vetter & al) teaches another device which allows a finite number of discrete angular orientations of the boot with respect to the snowboard. An inherent consequence of this device is that the boot is substantially raised above the surface of the snowboard. This device does not require a plurality of holes in the snowboard itself.

U.S. Pat. No. 5,356,170 (Carpenter et al.) also show snowboard boot binding systems of a popular type that employs a "mounting disk" that engages a circular opening in a boot mounting plate whose bottom is supported on a snowboard. A number of vertical bores through the "mounting disk" allow it to be secured to threaded bores in the board using threaded bolts or screws, and ordinarily there are extra pairs of threaded bores in the board to allow adjustment between the fore and aft bindings in several different longitudinal positions, to accommodate the desired feet-apart stance of the rider. There are ridges or splines on the "mounting disk" that engage complementary ridges or splines on the binding plate, to secure the plate at a given angular orientation.

The 4-hole system is described in the following patents: U.S. Pat. No. 5,236,216 (Ratzek) teaches a "mounting disk" that allows a continuous selection of orientation angles of the binding with respect to the central snowboard axis.

The means by which the rotation of the base plate with respect to the hold down plate is arrested involves a friction lining in combination with the axial force of the fasteners that has a direction generally normal to the surface of the snowboard.

Another approach to the need for rotatably adjustable bindings is revealed in U.S. Pat., No. 5,499,837 (Hale). The system of the Hale patent appears to be an improvement, however it's locking mechanism that depends on specially formed vertically opposed undulating surfaces that can be brought in and out of engagement, appears unduly complex and expensive.

U.S. Pat. No. 5,553,883 (Erb) teaches a device which allows adjustment of the orientation of the binding with respect to the snowboard central axis. It is, however, limited to discrete angular positions and requires a mating circular pattern of holes in the snowboard. This mating hole pattern is undesirable because it is expensive, weakens the snowboard and most importantly does not allow for any adjustment to the location of the pivot axis with respect to the snowboard central axis.

U.S. Pat. No. 5,826,910 (Ricks) teaches a swivelable bindings assembly for a snowboard for selective rotational adjustment of the bindings about an axis normal to the upper surface of the snowboard which includes a rotatably adjustable bindings plate having a bottom surface, an upper portion adapted for releasably supporting a user's boot, and a relatively large diameter circular opening in the central portion of the plate. The assembly includes a holds-down disk that is received in the plate opening and is adapted to slidably engage edge portions of the plate opening to restrain the plate against upward separation from the disk and to hold the plate with its bottom surface slidably engaged with, and vertically supported by, the low-friction planar surface of a sheet of material secured to the top of the snowboard, the disk also serving to mount the plate for rotation about an axis through the center of the disk. Mechanism for releasably locking the plate at selected rotational positions includes a locking pin with an elongate shaft that engages a horizontal bore extending from an edge of the base plate to the base plate opening, the plate being rotatable to bring the bore in alignment with at least one recess in the outer edge of the disk whereby the pin shaft can be engaged in a selected recess to secure the plate against rotation. These bindings for snowboards can be adjusted with respect to its angular orientation to the longitudinal centerline of the snowboard.

U.S. Pat. No. 6,189,899 (Carlson) describes a complex binding system that can be fitted on a 4-hole pattern snowboard and is characterized by a quick release feature.

U.S. Pat. No. 5,577,755 (Metzger & al), U.S. Pat. No. 5,586,779 (Dawes & al), U.S. Pat. No. 5,667,237 (Lauer), U.S. Pat. No. 5,763,358 (Hale), U.S. Pat. No. 6,015,161 (Carlson) and U.S. Pat. No. 6,062,584 (Satol) also describe various snowboard binding systems using the 4-hole pattern.

While the aforementioned binding support systems have their advantages, they all share a major drawback in that they cannot be used both with a 3-hole pattern snowboard and a 4-hole pattern snowboard in a simple manner.

The three-hole snowboard pattern is used exclusively by Burton Snowboards, the assignee of U.S. Pat. No. 5,261,689. The vast majority of the remaining snowboard manufacturers use the four-hole pattern. Snowboard bindings distributed by nearly all snowboard binding manufacturers are generally marketed and sold as separate and distinct units from the snowboard to with they will be mounted. They are generally designed, marketed and sold to be compatible with both the four-hole and three-hole systems. To render the bindings compatible they are either supplied with both types of disks (see for example U.S. Pat. No. 5,941,552 (Beron) or supplied with a multi-compatible disk.

Three-hole and four-hole, disks generally have elongated holes that provide adjustment of the disk position on the snowboard relative to the centerline and/or the longitudinal axis of the snowboard. This is a very desirable feature that consumers have grown to expect on all snowboard bindings. It is usually necessary to severely restrict or eliminate this feature on multi-compatible disks to preserve sufficient structural integrity.

Multi-compatible disks generally have a three-hole pattern nested in various ways within a four-hole pattern. The nested hole patterns also require many holes that subsequently impair the structural integrity of the disk, making it more flexible and/or more susceptible to failure. Furthermore, very few existing mounting disks can be fitted both on 3-hole pattern snowboards and 4-hole pattern snowboards. Those that can be mounted on both hole patterns are complex to install. See for example U.S. Pat. No. 5,967,542 to (Williams & al) which shows a "mounting disk" adapted to be fitted both on 3-hole pattern snowboards and on 4-hole pattern snowboards. The disk comprises a plurality of discrete holes each provided with a recess destined to receive 3 or 4 positioners through which the mounting screws are mounted. Although the binding can be fixed on both 3-hole pattern snowboards and 4-hole pattern snowboards, the required orientation, and exact placement of the positioners render its installation relatively complicated.

As is apparent from the specific descriptions of prior art above, all of the currently known or utilized systems have at least one of the following inherent disadvantages: complexity, including many parts and therefore bulky or heavy mountings, undue production expense and/or lack of reliability; or inability to be easily reoriented; or failure to allow for small adjustments of the location of the rotation center of the binding with respect to the central axis of the snowboard; or requirement for special hole patterns in the snowboard in addition to, or instead of, the industry standard patterns used for securing disks to snowboards. With a 3-hole snowboard, a preferred embodiment of this invention allows riders to achieve 1.7 mm adjustment increments laterally and 12.5 mm longitudinal adjustment increments. The prior art 3-hole disk allows only 5 mm lateral and 25 mm longitudinal adjustment increments. With a 4-hole snowboard, a preferred embodiment of this invention allows 1.7 mm lateral and 40 mm longitudinal increments or by turning the disk 90 degrees, 1.7 mm longitudinal and no lateral increments. A standard 4-hole disk allows only for 4 to 5 mm adjustment increments.

Furthermore, the interface between the mounting disk and the base plate on most prior art bindings (i.e. the overlapping region) can create stress points where cracks can start when strain is applied to the binding. Unlike the lap joint type of overlap (see U.S. Pat. Nos. 5,236,216 and 5,553,883) or the Burton frusto-conic shape (see U.S. Pat. No. 5,261,689), the disk of the instant invention has no sharp corners that create stress risers where cracks can start. It also efficiently achieves stability in all translation directions. In a preferred configuration, the conical teeth more efficiently transmit radial and tangential forces from the disk to the base plate than conventional ridged teeth.

SUMMARY OF THE INVENTION

In view of the foregoing, it is a general object of the present invention to provide for a snowboarder, the capability of rapidly and easily installing his binding on a standard 3-hole pattern snowboard or on a standard 4-hole pattern snowboard.

It is another object of this invention to improve the state of the art of multi-compatible mounting disks by providing a mounting disk for securing a compatible binding base plate to a snowboard having a three-hole pattern or a four-hole pattern.

It is a further object of this invention to provide a multi-compatible "mounting disk" with improved structural integrity.

It is a further object of this invention to provide a multi-compatible mounting disk with finer angular adjustment.

It is a further object of this invention to provide a multi-compatible mounting disk with improved transfer of forces from the disk to the binding base plate.

It is a further object of this invention to provide a multi-compatible mounting disk with finer adjustment of the disk position relative to the centerline or longitudinal axis of the board.

It is a further object of this invention to provide a multi-compatible mounting disk that is simpler than other multi-compatible disks, more cost effective than providing both types of disks, and improves upon the performance of existing disks.

Another object is to provide for a snowboarder, the capability of easily, quickly, and effectively, making fine adjustments to the angular orientation of the binding with respect to the centerline of the snowboard.

These and other objects and advantages are provided by the present invention of a multi-compatible "mounting disk" with two holes for securing a snowboard binding base plate to either a three-hole compatible or four-hole compatible snowboard using either three or four fastening elements.

The disk includes two elongated holes that can receive either one or two fastening elements hat pass through the disk and mate with corresponding fastening elements in the snowboard. The fastening elements engage the holes in such a way as to restrain movement of the disk perpendicular to the snowboard top surface and the shafts of the fastening elements restrain translation and rotation of the disk in a plane parallel to the top surface of the snowboard. Teeth in the region surrounding the holes, engage teeth in the fastening elements to further restrain translation and rotation. The spacing of these teeth is such that the fastening elements will always align properly with the mating elements in a three-hole or four-hole snowboard. Referring to FIG. 2, the shafts of the fastening elements engage the walls of the holes closest to the center of the disk when mated with the fastening elements on a three-hole compatible board. The shafts of the fastening elements engage the walls of the holes farthest from the center of the disk when mated with the fastening elements on a four-hole compatible board.

The perimeter of the disk provides an overlapping region that mates with a corresponding overlapping region on the base plate, the shape of which is contoured in such a way as to minimize the stresses resulting from the various loads that can be transferred from the disk to the base plate. The shape of this contour also provides regions substantially perpendicular and substantially parallel to the direction of insertion into the base plate in order to efficiently resist upward loads and translation loads from the base plate. The shape further provides a region for features that efficiently resist rotational loads from the base plate and can be engaged and disengaged with a small movement in the insertion direction.

There is a mounting disk adapted to be bolted to the snowboard, and its outer edge has a lower part with a plurality of generally conical teeth for engaging the splines and/or sockets of the base plate to hold down the base plate and affix it at a selected rotational position relative to the centerline of the snowboard.

Other aspects and many of the attendant advantages will be more readily appreciated as the same becomes better understood by reference to the following detailed description and considered in connection with the accompanying drawings in which like reference symbols designate like parts throughout the figures.

The features of the present invention which are believed to be novel are set forth with particularity in the appended claims.

BRIEF DESCRIPTION OF THE DRAWINGS

These and other features and advantages of the present invention will be better understood by reading the following detailed description, taken together with the drawings wherein.

Figure 1:
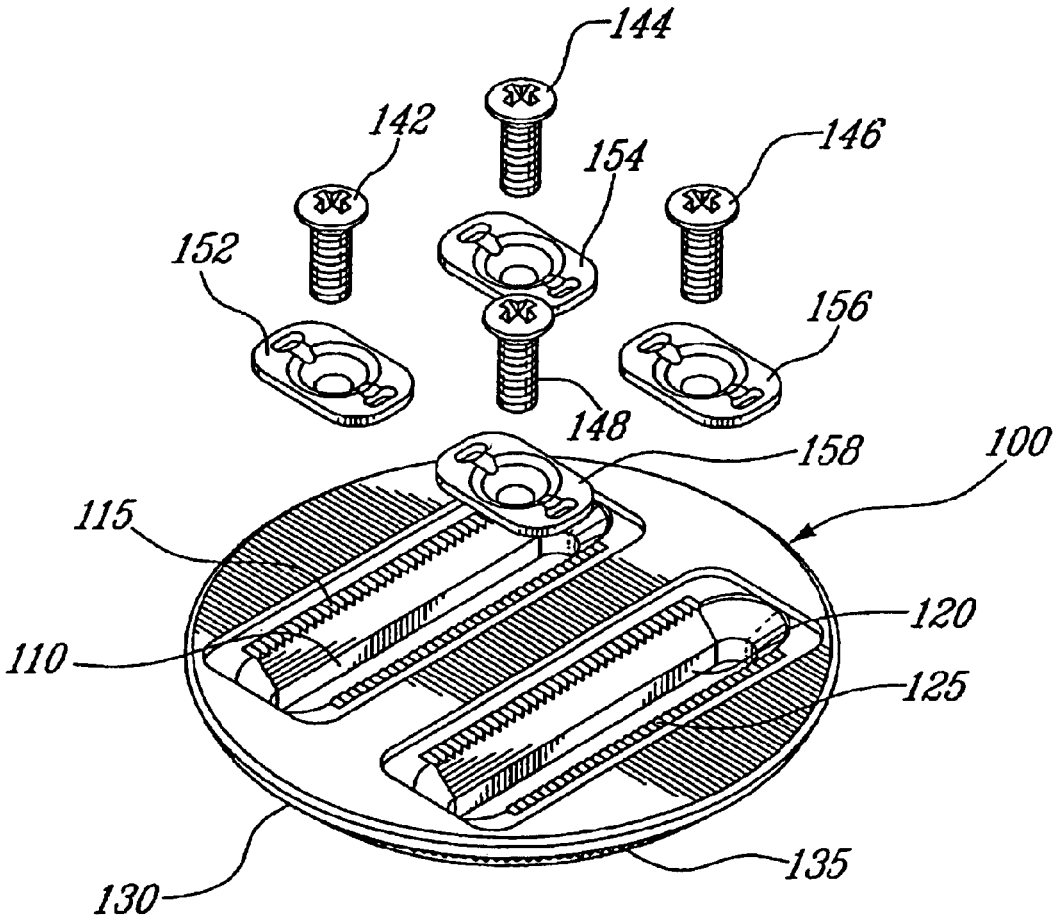
FIG. 1 is an exploded perspective drawing of one embodiment of a mounting disk, for a snowboard binding made according to the invention and shown in conjunction with 4 screws and 4 mounting flanges disposed according to a standard 4-hole mounting pattern.

From the foregoing it can be seen that a mounting disk for a snowboard binding has been described. It should be noted that the sketches are not drawn to scale and that distance of and between the figures are not to be considered significant.

Accordingly it is intended that the foregoing disclosure and showing made in the drawings shall be considered only as an illustration of the principle of;the present invention.

DESCRIPTION OF A PREFERRED EMBODIMENT

Referring now to the details of the drawings, FIG. 1 shows a "mounting disk" 100 provided with slots 110 and 120 and a series of generally conical teeth 135. Also shown in FIG. 1 are 4 mounting screws 142, 144, 146 and 148 and 4 mounting flanges 152, 154, 156 and 158. Each slot 110 and 120 is respectively provided with a series of teeth 115 and 125. Each end of the underside of flanges 152, 154, 156 and 158 is provided with a series of teeth that are complementary to teeth 115 and 125.

Figure 9:
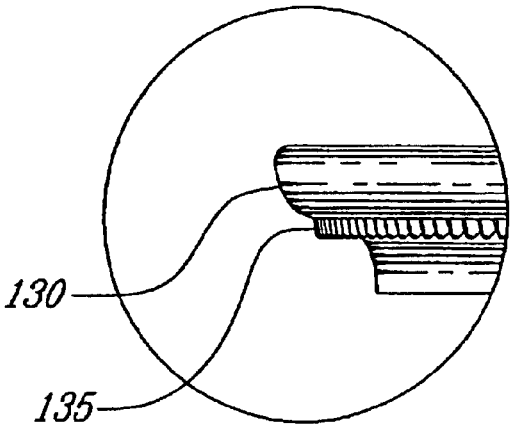
FIG. 9 is an enlarged side view of a portion of FIG. 8 and more particularly the detail identified as B.
Figure 10:
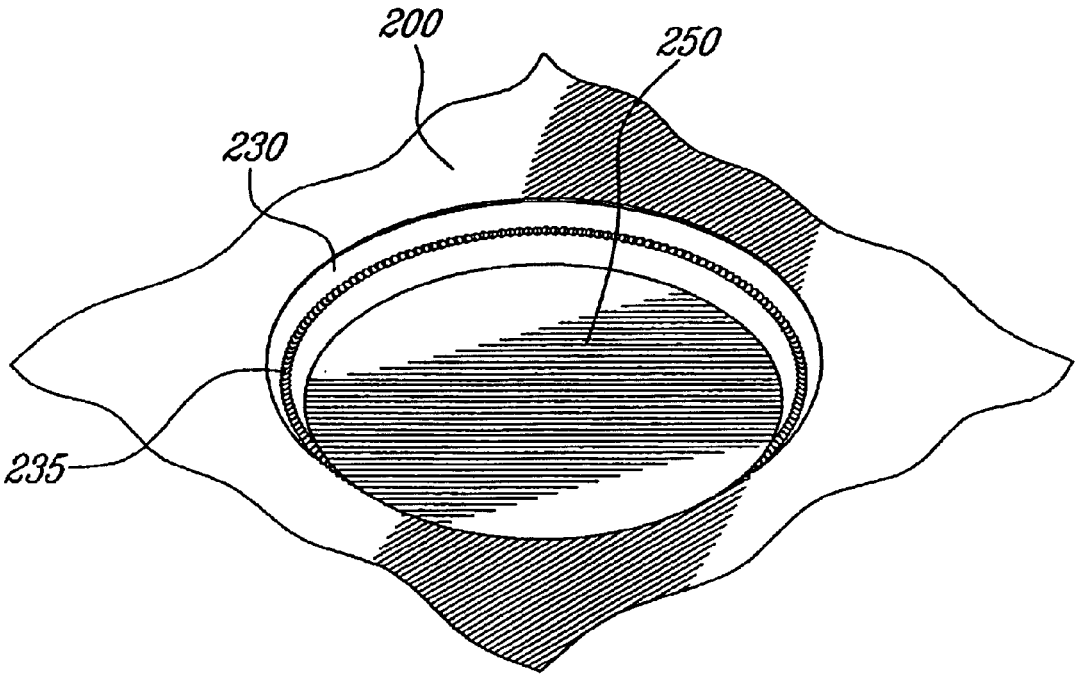
FIG. 10 is a perspective view of part of a base plate in which the mounting disk shown in FIG. 2 is to be placed.

As shown in FIG. 9, the disk perimeter 130 is non frusto-conic shaped and works in conjunction with the generally conical teeth 135 to retain the mounting disk 100 to the base plate 200 (see FIG. 10) without having the draw backs of existing frusto-conic disk perimeters. The base plate 200 comprises an opening 250 defining a perimeter 230 having a complementary shape to that of disk perimeter 130. Similarly, the generally conical teeth 135 fit into complementary staped recesses 235 in the base plate perimeter 230. Frusto-conic perimeter drawbacks include: 1) sharp corners which are stress risers and provide a place for cracks to start more easily, and 2) proper nesting depends on the accuracy of at least two surfaces rather then one. The disk perimeter 130 is also not of the lap joint type and is therefore free of their drawbacks that include the fact that the cross-section of mating pieces doesn't increase with increasing stress as does the cross-section of the disk 100 near its perimeter 130.

The generally conical teeth 135 help constrain the disk 100 to the binding in both radial and tangential directions. This is a distinctive advantage over traditional ridged teeth.

Figure 2:
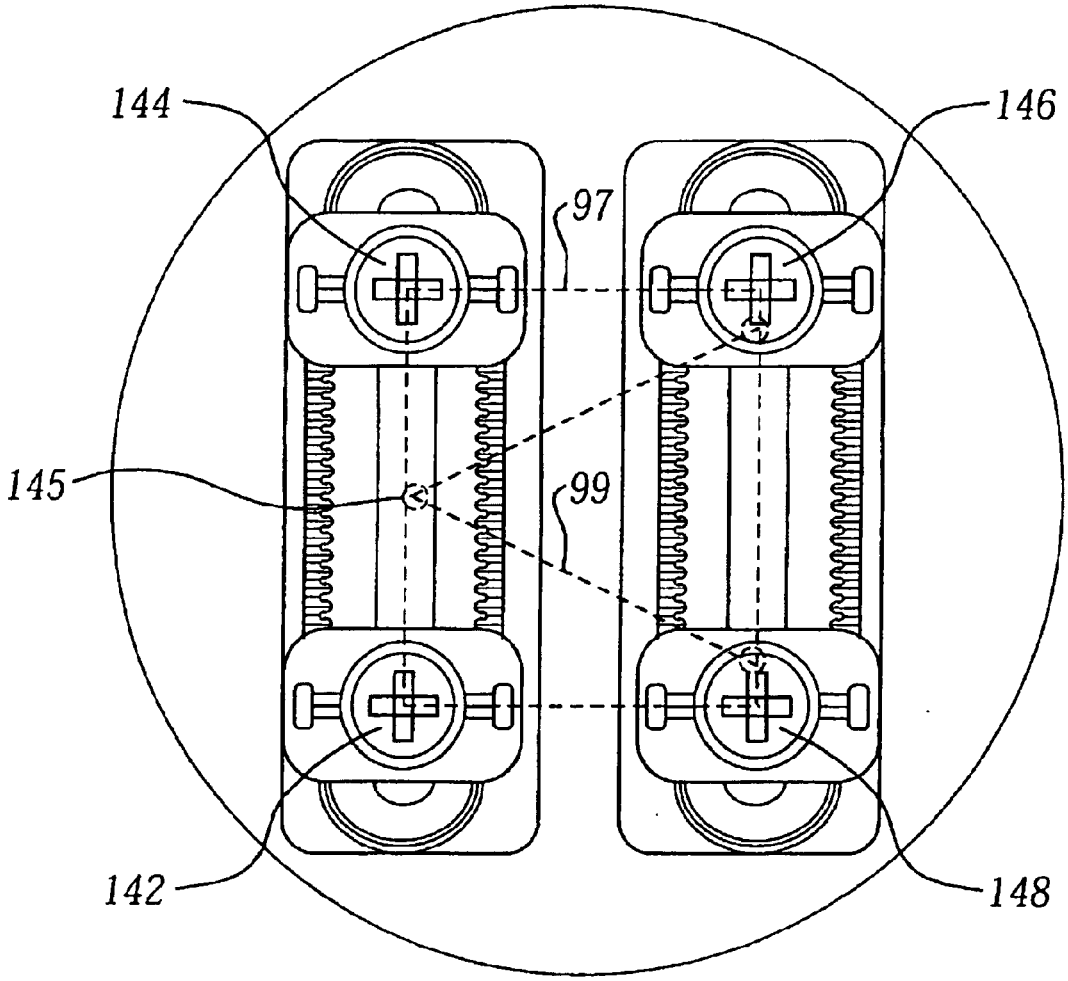
FIG. 2 is a top view of the mounting disk shown in FIG. 1 as installed in a standard 4-hole mounting pattern.
Figure 3:
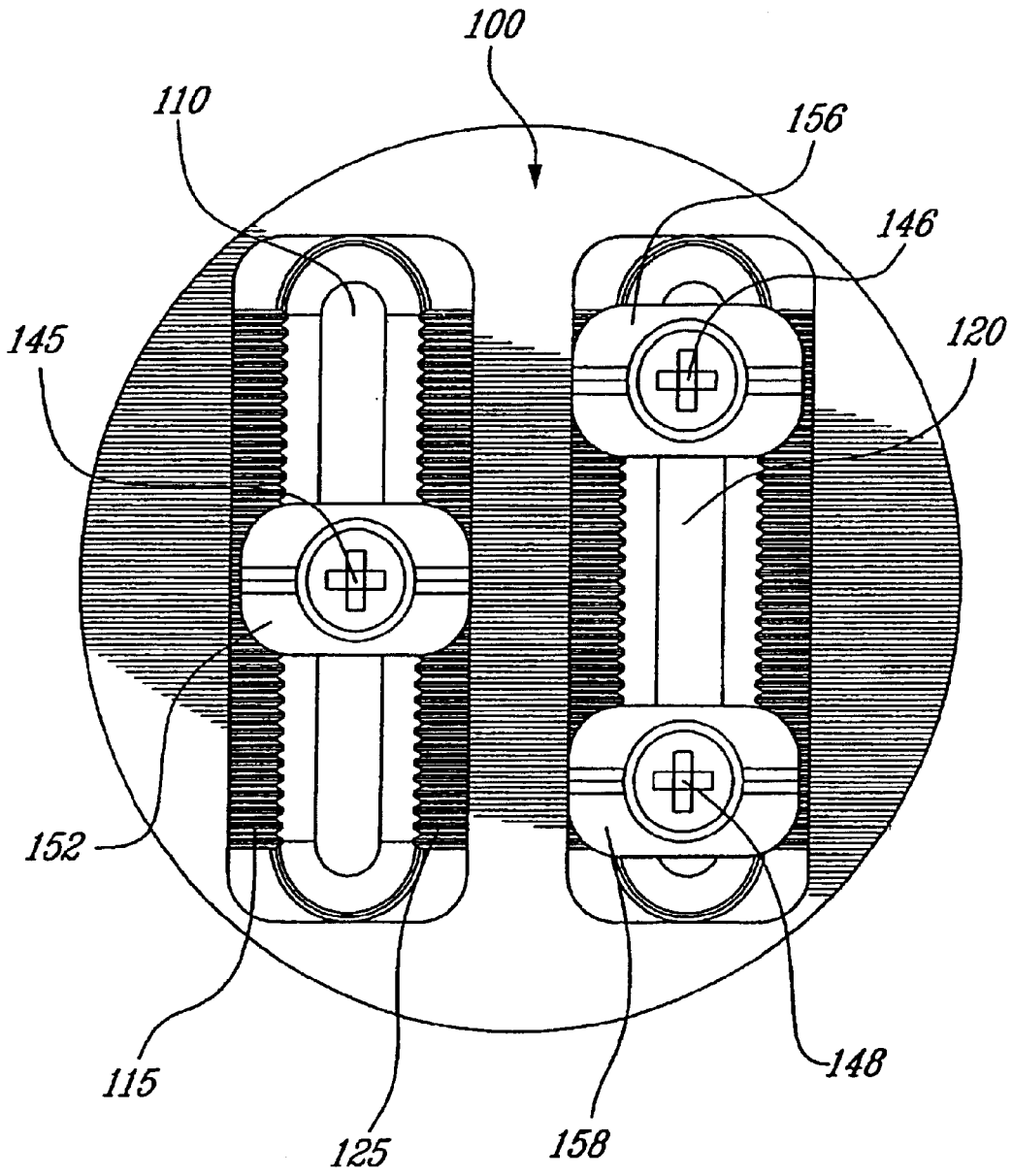
FIG. 3 is a top view of the mounting disk shown in FIG. 1 as installed in a 3-hole mounting patterns.
Figure 4:
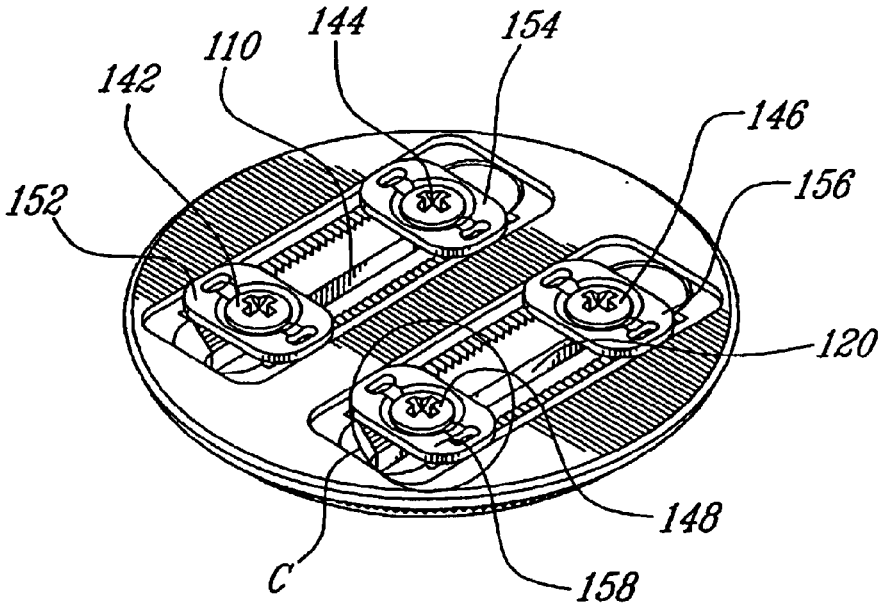
FIG. 4 is a perspective top view of the mounting disk shown in FIG. 2.
Figure 5:
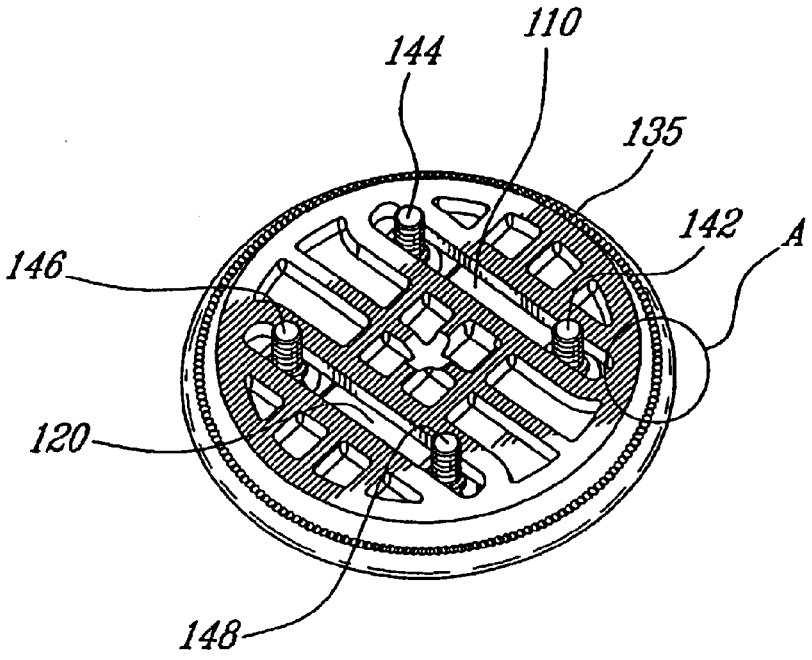
FIG. 5 is a perspective bottom view of the mounting disk shown in FIG. 2.
Figure 6:
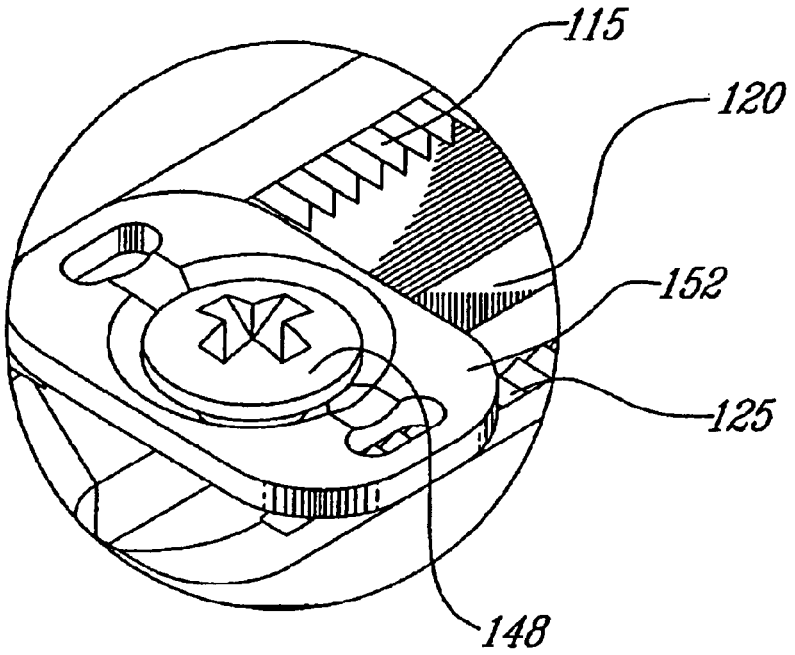
FIG. 6 is an enlarged partial perspective view of one of the mounting screws and mounting flanges shown in FIG. 4, and more particularly of the detail identified as C.
Figure 7:
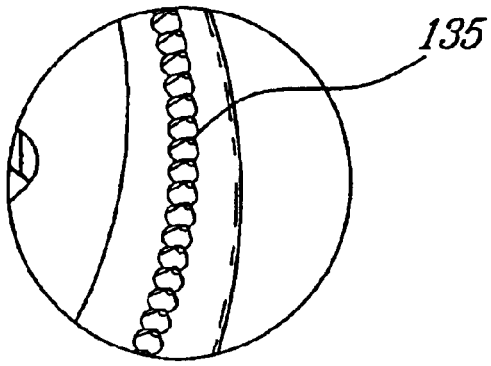
FIG. 7 is a partial enlarged view of a portion of the bottom of the "mounting disk" shown in FIG. 4 and more particularly of the detail identified as A.
Figure 8:
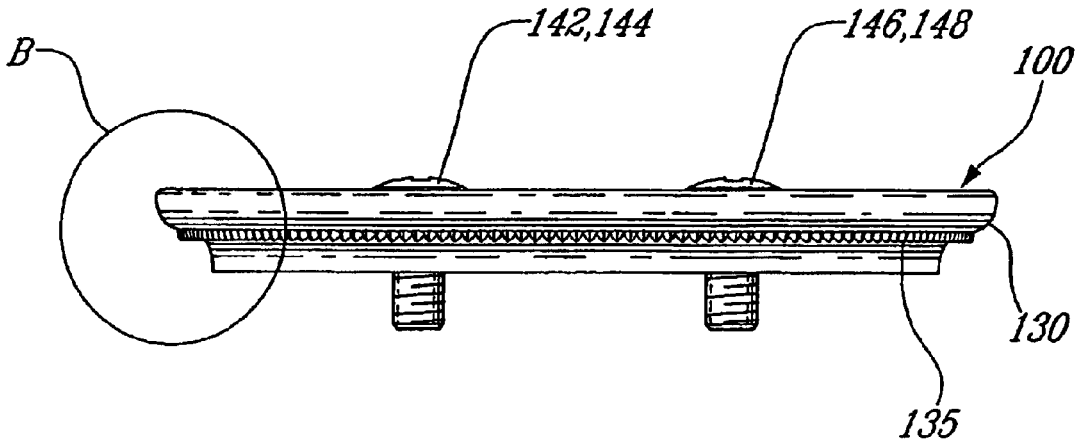
FIG. 8 is a side view of the mounting disk shown in FIG. 2.

Although FIG. 2 shows four mounting screws faced in positions 142, 144, 146, and 148 and the corresponding mounting flanges 152, 154, 156 and 158 aligned in accordance with the standard 4-hole mounting pattern 97 (used by a first group of snowboard manufacturers), also shown is position 145 in which a mounting screw and corresponding mounting flange 152 or 154 can be placed. When a mounting screw and mounting flange are placed in position 145, the resulting configuration (positions 145, 146 and 148) corresponds to the standard 3-hole mounting pattern 99 used by other manufacturers. The fastening elements in positions 145, 146, and 148 (i.e., the standard 3-hole mounting pattern) are preferably disposed proximate the walls of the elongated opening closest to the center of the disk. In contrast, the fastening elements in positions 142, 145, 146, and 148 (i.e., the standard 4-hole mounting pattern) are preferably disposed proximate the walls of the elongated opening farthest from the center of the disk. According to another embodiment, the first elongated opening 110 is sized and shaped to enable adjustment along au least one direction (preferably two directions) substantially parallel to the longitudinal face of the snowboard. As a result, the first elongated opening 110 can accept a single fastening element 145 (when he mounting disk is used with the three-hole mounting pattern) or two fastening elements 142, 944 (when the mounting disk is used with the four-hose mounting pattern). The second elongated opening 120 is sized and shaped to enable a two-dimensional adjustment along the plane substantially parallel to the longitudinal face of the snowboard. Consequently, the second elongated opening 120 can accept two fastening elements 146, 148 when the mounting disk is used with the three-hole or four-hole mounting patterns. This adjustment allows the mounting disk to compensate for the difference in height between the three-hole mounting pattern (i.e., the perpendicular distance between position 145 and positions 146 and 148) and the four-hole mounting pattern (i.e., the perpendicular distance between positions 142, 144 and positions 146 and 148).

Modifications and substitutions by one of ordinary skill in the art are considered to be within the scope of the present invention which is not to be limited except by the claims which follow.

What is claimed is:

1. A mounting disk for easily selectively mounting a base plate of a snowboard binding to a snowboard in a first position having a three mounting hole pattern and a second position having a four mounting hole pattern, said mounting disk comprising:

i. a first and a second elongated openings each having a width, a length substantially greater than said width, and a longitudinal axis substantially parallel to each other, wherein said firs elongated opening is sized and shaped to enable adjustment along at least one direction substantially parallel to a longitudinal face of said snowboard such that said first elongated opening accepts two mounting means while said mounting disk is disposed in either said first or said second position, and said second elongated opening is sized and shaped to enable a two-dimensional adjustment along a plane substantially parallel to said longitudinal face of said snowboard such that said second elongated opening accepts a single mounting means while said mounting disk is disposed in said first position and two mounting means while said mounting disk is disposed in said second position ii. a plurality of mounting flanges adapted to be placed in said openings, each mounting flange being adapted to matingly engage with one of said mounting means; and iii. an outer edge adapted to matingly engage with said base plate.

2. A mounting disk for a snowboard binding as described in claim 1 wherein the mounting disk is round.

3. A mounting disk for snowboard binding as described in claim 2 wherein the underside of said outer edge is provided with engagement means.

4. A mounting disk for a snowboard binding as described in claim 3 wherein said engagement means are a plurality of projections.

5. A mounting disk for snowboard binding as described in claim 3 wherein said engagement means are a plurality of cones.

6. A mounting disk for a snowboard binding as claimed in claim 2 wherein a recess is provided on both sides of each said openings and wherein a plurality of engagement means are provided therein.

7. A mounting disk for a snowboard binding as claimed in claim 6 wherein such engagement means are a series of vertically extending projections.

8. A mounting disk for a snowboard binding as claimed in claim 6 wherein such engagement means are a series of vertically extending teeth or ridges.

9. A mounting disk for a snowboard binding as claimed in claim 7 wherein the underside of each end of each said mounting flanges is shaped such that it is matingly engageable with said projections.

10. A mounting disk for a snowboard binding as claimed in claim 8 wherein the underside of each end of each said mounting flanges is shaped such that it is matingly engageable with said teeth or ridges.

11. The mounting disk as claimed in claim 1 wherein said first elongated opening is sized and shaped to enable a two-dimensional adjustment along a plane substantially parallel to said longitudinal face of said snowboard.

12. The mounting disk as claimed in claim 11 wherein said first and said second elongated openings include a first and a second side wall, respectively, which are proximate each other and a third and a forth side wall, respectively, which are distal from each other, wherein one mounting means is disposed within said first elongated opening proximate said first side wall and two mounting means are disposed within said second elongated opening proximate said second side wall when said mounting disk is disposed in said first position, and wherein two mounting means are disposed within said first slot proximate said third side wall and two mounting means are disposed within said second elongated opening proximate said fourth side wall when said mounting disk is disposed in said second position.

13. A mounting disk for easily selectively mounting a base plate of a snowboard binding to a snowboard in a first position having a three mounting hole pattern and second position having a four hole mounting pattern, said mounting disk comprising:

i. a center;

ii. a first elongated opening having a longitudinal axis, a first side wall which is distal from said center, and a second side wall which is proximal from said center, wherein one mounting means is disposed proximate said second side wall when said mounting disk is disposed in said first position and two mounting means are disposed proximate said first side wall when said mounting disk is disposed in said second position;

iii. a second elongated opening having a longitudinal axis substantially parallel to said longitudinal axis of said first elongated opening, a third side wall which is distal from said center, and a fourth side wall which is proximal from said center, wherein two mounting means are disposed proximate said fourth side wall when said mounting disk is disposed in said first position or are disposed proximate said third side wall when said mounting disk is disposed in said second position;

iv. a plurality of mounting flanges adapted to be placed in said openings, each mounting flange being adapted to matingly engage with one of said mounting means; and v. an outer edge adapted to matingly engage with said base plate.

14. The mounting disk as claimed in claim 13 wherein said first elongated opening is sized and shape to enable adjustment along at least one direction substantially parallel to a longitudinal face of said snowboard and said second elongated opening is sized and shaped to enable a two-dimensional adjustment along a plane substantially parallel to said longitudinal face of said snowboard.

* * * * *